United States Patent [19]

Burke, Jr.

[11] Patent Number: 4,721,475

[45] Date of Patent: Jan. 26, 1988

[54] SAFETY SHROUD FOR AN ELECTRICAL CONNECTOR

[76] Inventor: Roland A. Burke, Jr., 6650 Loud Dr., Oscoda, Mich. 48750

[21] Appl. No.: 932,576

[22] Filed: Nov. 20, 1986

[51] Int. Cl.[4] ..... H01R 13/44

[52] U.S. Cl. ..... 439/133; 439/147; 439/304

[58] Field of Search ..... 339/37, 39, 75, 82, 339/84, 85, 87, 90 R, 90 C, 91 R, 91 P

[56] References Cited

U.S. PATENT DOCUMENTS

| | | | |
|---|---|---|---|
| 4,590,540 | 5/1986 | Nicholson et al. | 339/75 R |
| 4,598,964 | 7/1986 | Frink et al. | 339/37 |
| 4,676,569 | 6/1987 | Lambert et al. | 439/133 |

*Primary Examiner*—Gil Weidenfeld
*Assistant Examiner*—Paula A. Austin
*Attorney, Agent, or Firm*—Remy J. VanOphem

[57] ABSTRACT

A shrouded electrical connector assembly with a male plug and a female socket, the male plug being contained within an insulating cup-shaped shroud and the female socket being contained within another insulating cup-shaped shroud. The male plug cup-shaped shroud is telescopable into the female socket cup-shaped shroud and a bayonet-type contact is provided between the male plug shroud and the female socket shroud. The male plug shroud partially telescopes into the female socket shroud before the male plug engages the female socket, and the male plug shroud and the female socket shroud each have aligned and opposed apertures to permit the shank of a T-shaped locking bar to be inserted therethrough, physically preventing the male plug from being brought into contact with the female socket. The locking bar is secured to the shrouded electrical connector assembly by a flexible cable and its shank is provided with one or more apertures to permit a lock to be attached therethrough. The lock prevents the locking bar from being withdrawn from its locking position until the lock is removed.

17 Claims, 5 Drawing Figures

SAFETY SHROUD FOR AN ELECTRICAL CONNECTOR

BACKGROUND OF THE INVENTION

1. Field of the Invention

This invention relates to a shroud assembly for an electrical connector, that is, to a shroud assembly for an electrical connector which is made up of a female socket and a male plug that is insertable into the socket to make electrical contact therewith, and each of which is surrounded by a shroud. The socket and the plug are enshrouded by providing each with a cup-shaped insulating shroud member, one of which is slidably mounted into the other to permit the connection and disconnection of the electrical connector, the shroud members being designed to interlock with each other when assembled as well as to receive a lockout bar extending between the female socket and the male plug to prevent the inadvertent reconnection of the disconnected electrical connector.

2. Description of the Prior Art

It is known in the prior art to provide the engaged female plug and male socket components of an electrical connector with a protective cover or casing of an insulating material to surround the connected electrical connector and to thereby help to prevent electrical contact and offer a degree of safety to a user who may be grasping the plug and socket components in opposite hands during the connection of the plug and socket components to one another or during their disconnection. U.S. Pat. Nos. 4,429,938 (Flor) 4,003,622 (Gartland, Jr.) and 4,274,692 (Hoffman et al) are examples of such protective covers for electrical connectors.

For obvious safety reasons, and for compliance with safety standards or regulations based on such reasons, it is often desired to provide a safety lockout to a disconnected electrical connector, for example, when servicing machinery which receives its electrical supply through such electrical connector. Otherwise, serious accidents involving the personnel engaged in such machinery servicing activities could occur upon the accidental or inadvertent reconnection of the disconnected connector while the machinery is being serviced. At present, the lockout is generally provided by constructing the switch box that is in the circuit with the electrical connector to receive a key-operated or combination lock so that the switch box cannot be opened to throw the switch to the "on" position except by a person who has a key or the combination to the lock. Unfortunately, however, the electrical connector and the switch box that is in its circuit are often physically remote from one another, and it is not always possible to see machinery being serviced from the location of the switch box, a factor which creates a high risk to the personnel involved in servicing the machinery since there may be duplicate keys to the lock on the switch box or there may be more than one person familiar with its combination. Accordingly, what is needed is a shrouded electrical connector with a safety lockout feature within the shroud which permits the electrical connector to be used according to its intended function, and which further provides an interlock for the male plug and female socket members when the electrical connector is assembled as well as to provide a safety lockout bar between the male plug and female socket to prevent the inadvertent reconnection of the disconnected electrical connection while the machinery is being serviced.

SUMMARY OF THE INVENTION

According to the present invention there is provided a shrouded electrical connector that is made up of a female socket and a male plug that is insertable into the female socket to make electrical contact between a line connected to the male plug and a line connected to the female socket. The female socket is surrounded by a generally cup-shaped shroud that is formed from a suitable insulating material, and the male plug is also surrounded by a generally cup-shaped shroud that is formed from a suitable insulating material. The male plug with its cup-shaped shroud is engaged in the cup-shaped shroud that surrounds the female socket. The engagement of the male plug cup-shaped shroud into the female socket cup-shaped shroud begins before the male plug engages the female socket to energize the electrical components. Preferably, the male plug cup-shaped shroud and the female socket cup-shaped shroud are designed to be engaged together only in a given circumferential orientation with respect to one another to ensure the correct circumferential orientation of the female socket and male plug with respect to one another at the time when the male plug and female socket begin to engage one another. Also, it is desirable to provide a bayonet-type of coupling feature between the male plug cup-shaped shroud and the female socket cup-shaped shroud to prevent the accidental or inadvertent disconnection of the male plug and female socket and their respective cup-shaped shrouds. In any case, the shrouded electrical connector assembly is further provided with a locking bar that is associated therewith and attached thereto by a flexible line. The locking bar, which is T-shaped, has a shank portion which is insertable through aligned openings in the shrouded electrical connector assembly, between the disconnected male plug and female socket to prevent the reconnection of the male plug and female socket so long as the locking bar is in place, that is, extending through the aligned openings of the electrical connector assembly. To help to prevent the inadvertent removal of the locking bar from the shrouded electrical connector assembly, the locking bar is provided with one or more apertures in the shank portion thereof, and a key-operated or other locking device may be placed through any such aperture, the head portion of the locking bar being sufficiently large to ensure that it cannot pass through the aligned openings in the female socket shroud and the male plug shroud.

Accordingly, it is an object of the present invention to provide an improved shrouded electrical connector assembly. More particularly, it is an object of the present invention to provide an improved shroud for an electrical connector which provides both a safety lock as well as a lockout feature. Even more particularly, it is an object of the present invention to provide a shroud for an electrical connector with a safety locking device that is a part of the shroud to prevent a disconnected male plug and female socket of the electrical connector from being inadvertently or accidentally reconnected. For a further understanding of the present invention and the objects thereof, attention is directed to the drawing and the following brief description thereof, to the detailed description of the preferred embodiment and to the appended claims.

DETAILED DESCRIPTION OF THE PREFERRED EMBODIMENT

Figure 1:
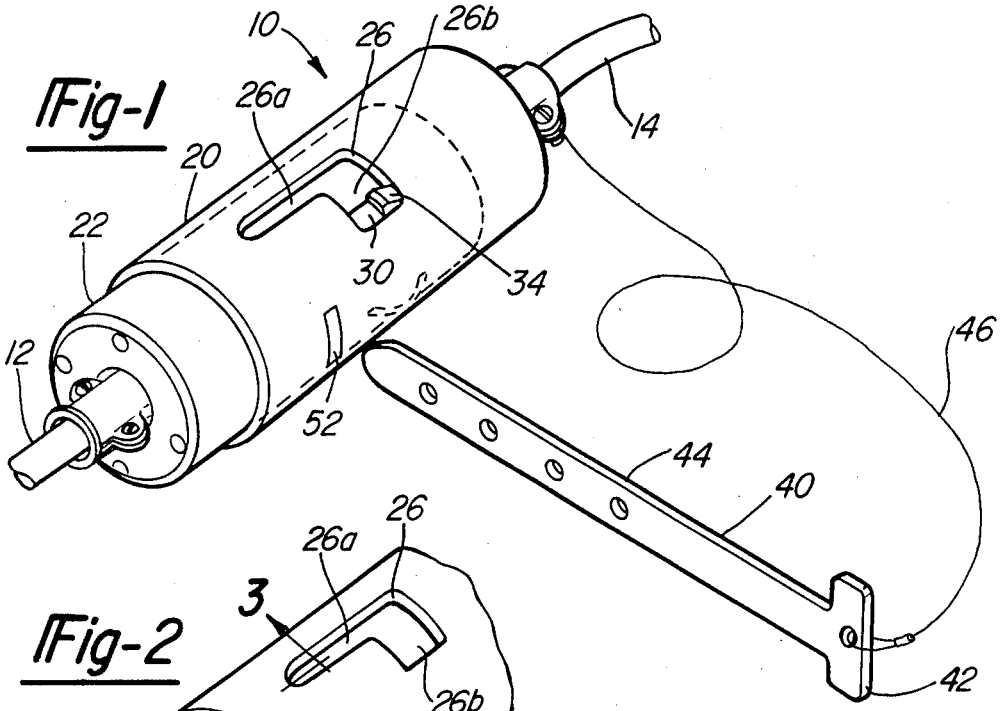
FIG. 1 is a perspective view of the preferred embodiment of an electrical connector according to the present invention.
Figure 2:
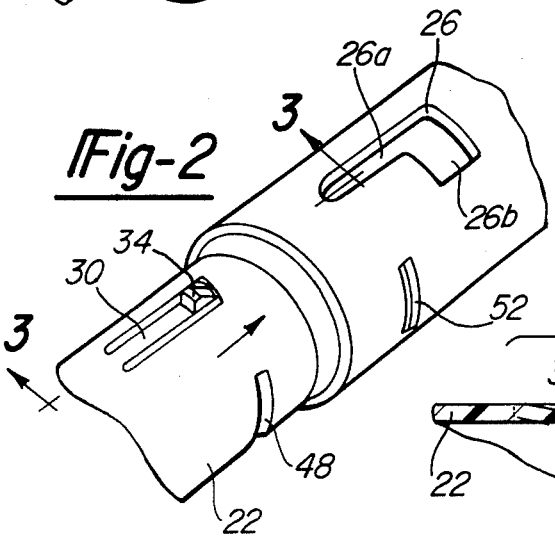
FIG. 2 is a fragmentary exploded perspective view of certain of the components of the electrical connector of FIG. 1.

A shrouded electrical connector assembly according to the present invention is identified generally by reference numeral 10 in FIG. 1, and serves to complete an electrical circuit between a lead 12 and a lead 14 when the electrical connecting elements within the shrouded electrical connector assembly 10, to be hereinafter described more fully, are electrically connected.

Figure 4:
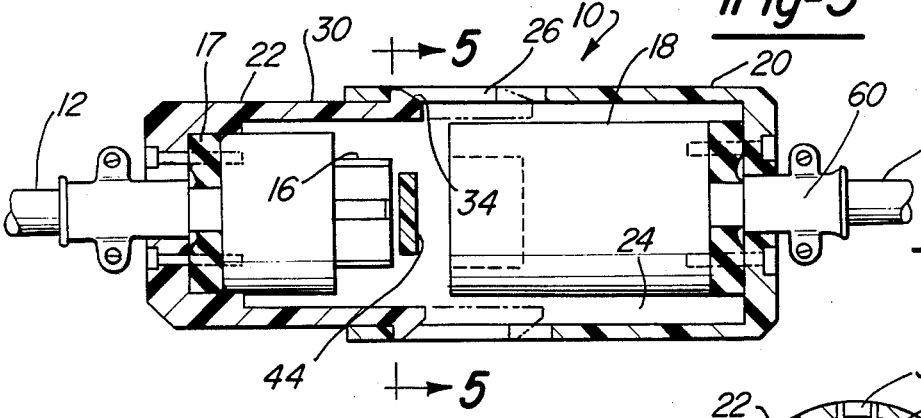
FIG. 4 is a longitudinal sectional view of the electrical connector of FIG. 1 after the insertion of the locking bar through the openings of the female socket shroud and male plug shroud of the electrical connector assembly.

As is shown in more detail in FIG. 4, the shrouded electrical connector assembly 10 includes a typical prior art male plug 16 from which has been removed the metal end cover (not shown) so that a rubber insulator material 17 may be directly mounted to a non-conducting shroud 22 by utilizing the same attachment arrangement as is provided with the prior art metal end cover of the male plug 16. Utilizing the inventive shroud of the present invention, therefore, enables the elimination of the prior art metal end cover in the shrouded electrical connector assembly 10. The male plug 16 is electrically connected to the lead 14 and a female socket 18, which receives the male plug 16, is electrically connected to the lead 14 to make electrical contact between the lead 12 and the lead 14. The female socket 18 like the male plug may be a typical prior art connector which is encased in a cup-shaped, non-conducting shroud 20 which also utilizes the rubber insulator 17 and the male plug 16 is also encased in the cup-shaped, non-conducting shroud 22. The cup-shaped, non-conducting shroud 22 of the male plug 16 is received in an annulus 24 located between the cup-shaped shroud 20 and the female socket 18 to permit the male plug 16 to be brought into electrical connection with the female socket 18. By so enshrouding both the male plug 16 and the female socket 18, a person may connect or disconnect the male plug 16 and the female socket 18 by grasping the cup-shaped shroud 22 and the cup-shaped shroud 20 in opposite hands, to thereby avoid any danger of an electrical shock due to touching the electrically conductive elements of the male plug 16 when connecting or disconnecting the male plug 16 and the female socket 18. For purposes which will hereinafter be explained more fully, the cup-shaped shroud 22 has a length, parallel to the longitudinal axis of the male plug 16, which is greater than the length of the male plug 16, and the cup-shaped shroud 20 has a length, parallel to the longitudinal axis of the female socket 18, which is greater than the length of the female socket 18. Thus, as is shown in FIG. 4, the cup-shaped shroud 22 will be partially telescopically received in the cup-shaped shroud 20 before the male plug 16 is brought into engagement with the female socket 18.

The cup-shaped shroud 20 and the cup-shaped shroud 22 are, preferably, each formed from a suitable non-conducting material, for example, molded thermoplastic nylon, such as a Nylon (polyamide) based material. Each of the cup-shaped shrouds 20 and 22 can be readily and relatively inexpensively mass produced from any suitable thermoplastic material. Such material lends itself to close dimensional manufacturing tolerances, by conventional injection molding practices and equipment.

Figure 3:
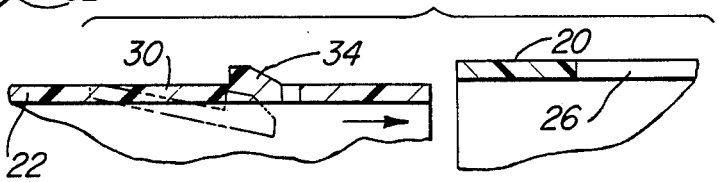
FIG. 3 is a sectional view taken on line 3—3 of FIG. 2.

To help prevent the breaking of the electrical contact between the male plug 16 and the female socket 18 under inadvertent or accidental tension loads applied to the leads 12 and 14, or even to prevent the accidental or inadvertent de-telescoping of the partially telescoped cup-shaped shrouds 20 and 22, as shown in FIG. 4, a bayonet-type of latch is provided between the cup-shaped shroud 22 of the male plug 16 and the cup-shaped shroud 20 of the female plug 18. Thus, the cup-shaped shroud 20 is provided with an L-shaped slot 26 and the cup-shaped shroud 22 is provided with a flexible finger 30 which, in turn, is provided with an outwardly projecting tab 34, the tab 34 preferably being generally wedge-shaped on its leading edge to facilitate the insertion of the cup-shaped shroud 22 into the cup-shaped shroud 20 and to ensure against the accidental or inadvertent withdrawal of the cup-shaped shroud 22 from the cup-shaped shroud 20. Thus, as is shown in FIG. 3 in connection with the flexible finger 30, which extends longitudinally of the cup-shaped shroud 22, by depressing the flexible finger 30 from the solid line position to the dotted line position, the front tip of the tab 34 will be momentarily moved inwardly until it clears the inside diameter of the cup-shaped shroud 20, to permit the cup-shaped shroud 22 to be telescoped into the cup-shaped shroud 20, and the flexible finger 30 will spring back into a longitudinally extending portion 26a of the L-shaped slot 26 to help maintain the cup-shaped shroud 22 partially engaged within the cup-shaped shroud 20. Upon the further advance of the cup-shaped shroud 22 into the annulus 24 within the cup-shaped shroud 20, the male plug 16 will become electrically connected to the female socket 18 and the tab 34 will become aligned with a laterally extending portion **26*b* of the L-shaped slot 26, at which time, by a slight twist of the cup-shaped shrouds 22 and 20 relative to one another, the tab 34 will be moved into the laterally extending portion 26*b* of the L-shaped slot 26 to secure the cup-shaped shroud 22 and the cup-shaped shroud 20 to one another in such position, at least until they are untwisted to bring the tab 34 into alignment with the longitudinally extending portion 26*a* of the L-shaped slot 26. By the use of a bayonet-type latch between the cup-shaped shroud 22 and the cup-shaped shroud 20, as heretofore described, there is provided precise circumferential orientation between the male plug 16 and the female socket 18**, and this is important for many types of plug and socket assemblies, for example, to ensure the proper electrical polarity for the various electrical contacts within the male plug and female socket components. While not illustrated in the drawing, more than one L-shaped slot may be used in combination with its associated flexible finger provided they are spaced about the periphery of the shrouded assembly.

A shrouded electrical connector assembly 10 of the type heretofore described is suitable for use in circuits that are designed to carry high voltage or high amperage loads, for example, the kinds of circuits that are used to power heavy industrial machinery. In the case of circuits that are used to power heavy industrial machinery, or in many other high voltage or high amperage industrial circuits, it is necessary from time to time to disconnect the electrical connection, for example, to permit personnel to adjust or otherwise service the machinery that is powered by such circuit. To ensure the safety of the personnel engaged in any such machinery servicing activity, it is important to be able to "lockout" the electrical reconnection of the circuit to prevent accidental or inadvertent reenergizing of the circuit and of the machinery until the personnel have moved to a position of safety, and many industrial or occupational safety codes and regulations mandate the use of such a lockout feature. Thus, the shrouded electrical connector assembly 10 according to the present invention has an integral lockout feature to eliminate the need for trying to lockout a disconnected male plug through a switch in a switch box that is adapted to receive a key-operated or other type of lock, or to serve as a backup lockout feature in an electrical system that also uses a locked switch box, since the shrouded electrical connector assembly 10 is more likely to be positioned within eyesight of the machinery being serviced than is the switch box for such machinery.

Figure 5:
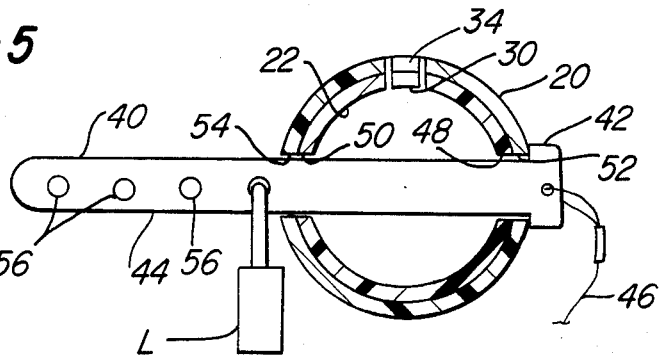
FIG. 5 is a sectional view taken on line 5—5 of FIG. 4.

The electrical lockout feature of the shrouded electrical connector assembly 10 involves the use of a lockout bar 40 which, as illustrated in FIGS. 1 and 5, is T-shaped in configuration with a head portion 42 and a shank portion 44. The lockout bar 40 is secured to the shrouded electrical connector assembly 10 by a flexible cable 46 which ensures against the inadvertent loss of the lockout bar 40. The cup-shaped shroud 22 is provided with opposed slots 48 and 50 and the cup-shaped shroud 20 is provided with opposed slots 52 and 54 which are in alignment with the slots 48 and 50, respectively, when the cup-shaped shroud 22 is partially telescoped into the cup-shaped shroud 20 but before the male plug 16 reaches the female socket 18, as is illustrated in FIG. 4, preferably after the tab 34 of the flexible finger 30 has engaged the L-shaped slot 26. When the slots 48, 50, 52, and 54 are so aligned, the shank portion 44 of the lockout bar 40 is inserted therethrough, thereby physically separating the male plug 16 and the female socket 18 so that they cannot be reconnected, with the head portion 42 of the lockout bar 40 having a greater dimension than the width of any of the slots 48, 50, 52, and 54 to prevent its withdrawal through the shrouded electrical connector assembly. The shank portion 44 of the lockout bar is provided with one or more apertures 56, shown as four such apertures, and when the shank portion 44 has been inserted through the slots 48, 50, 52, and 54, a lock L of the key-operated or combination type is attached to the shank portion 44 through one of the apertures 56 to prevent withdrawal of the lockout bar from its locking position, illustrated in FIGS. 4 and 5, until the lock L has been removed therefrom. The machinery can now be safely serviced without concern of accidental or inadvertent reconnection of the male plug 16 to the female socket 18.

Having, thus, described the present invention by way of an exemplary embodiment, it will be apparent to those skilled in the art that many modifications may be made from the exemplary embodiment without departing from the spirit of the present invention or the scope of the claims appended thereto.

What is claimed is:

1. A shrouded electrical connector assembly comprising:

a socket;

a plug which is insertable into said socket to make electrical content therewith;

first annular shroud means surrounding said plug and extending past said plug toward said socket;

second annular shroud means surrounding said socket and extending past said socket toward said plug, one of said first annular shroud means and said second annular shroud means being telescopically receivable in the other of said first annular shroud means and said second annular shroud means to permit said plug to be inserted into said socket, said one of said first annular shroud means and said second annular shroud means being partly telescoped into the other of said first annular shroud means and said second annular shroud means to a partly telescoped position before said plug is inserted into said socket;

aperture means in said first annular shroud means and extending across said first annular shroud means between said plug and said socket;

aperture means in said second annular shroud means and extending across said second annular shroud means between said plug and said socket, said aperture means in said second annular shroud means being in alignment with said aperture means in said first annular shroud means when said first annular shroud means and said second annular shroud means are in said partly telescoped position; and locking bar means, said locking bar means, said locking means being insertable between said socket and said plug when said first annular shroud means and said second annular shroud means are in said partly telescoped position to prevent said plug from making electrical contact with said socket, said locking bar means being selectively withdrawable from between said plug and said socket to permit said plug to make contact with said socket.

2. A shrouded electrical connector assembly according to claim 1 wherein said second annular shroud means defines an annulus surrounding said socket and wherein said first annular shroud means is telescopically receivable in said second annular shroud means at least partly in said annulus surrounding said socket.

3. A shrouded electrical connector assembly according to claim 1 and further comprising:

flexible cable means, said flexible cable means securing said locking bar means to one of said plug and said socket to safeguard against the loss of said locking bar means.

4. A shrouded electrical connector assembly according to claim 1 wherein one of said first annular shroud means and said second annular shroud means is a generally cup-shaped member, said generally cup-shaped member being fonmed of a non-conducting material to help to prevent electrical shock to a person grasping said one of said first annular shroud means and said second annular shroud means.

5. A shrouded electrical connector assembly according to claim 4 wherein said generally cup-shaped member is formed of a non-conducting thermoplastic material by injection molding.

6. A shrouded electrical connector assembly according to claim 4 wherein the other of said first annular shroud means and said second annular shroud means is a second generally cup-shaped member, said second generally cup-shaped member being formed of a non-conducting material to help prevent electrical shock to a person grasping said other of said first annular shroud means and said second annular shroud means.

7. A shrouded electrical connector assembly according to claim 6 wherein each of said generally cup-shaped member and said second generally cup-shaped member is formed of a non-conducting thermoplastic material by injection molding.

8. A shrouded electrical connector assembly according to claim 1 wherein said locking bar means comprises a generally T-shaped bar having a head portion and a shank portion, said shank portion being insertable through said aperture means in said first annular shroud means and said aperture means in said second annular shroud means, said head portion not being insertable through said aperture means in said first annular shroud means and said aperture means in said second annular shroud means.

9. A shrouded electrical connector assembly according to claim 8 wherein said shank portion is provided with aperture means, said aperture means being adapted to receive a lock to prevent said locking bar means from being withdrawn from between said plug and said socket.

10. A shrouded electrical connector assembly according to claim 1 wherein said one of said first annular shroud means and said second annular shroud means is generally circular in cross-section and comprises a flexible finger having a free end that is resiliently deflectable radially inwardly of said one of said first annular shroud means, said flexible finger having a tab projecting radially outwardly from said free end thereof, and wherein said other of said first annular shroud means and said second annular shroud means is generally circular in cross-section and comprises a generally L-shaped slot having a longitudinally extending portion and a laterally extending portion, said tab being receivable in said generally L-shaped slot to form a bayonet fit between said one of said first annular shroud means and said second annular shroud means by twisting said one of said first annular shroud means and said other of said first annular shroud means relative to one another to position said tab in said laterally extending portion of said generally L-shaped slot, said plug being in electrical contact with said socket when said tab is positioned in said laterally extending portion of said generally L-shaped slot.

11. A shrouded electrical connector assembly according to claim 10 wherein said tab has a leading edge and a trailing edge, said leading edge being generally wedge-shaped and said trailing edge being generally radially extending to facilitate the insertion of said one of said first annular shroud means and said second annular shroud means into the other of said one of said first annular shroud means and said second annular shroud means and to help to prevent the inadvertent withdrawal of said one of said first annular shroud means and said second annular shroud means from the other of said first annular shroud means and said second annular shroud means.

12. In combination with an electrical connector of the type having a female socket and a male plug which is insertable into said female socket to make electrical contact therewith, the improvement comprising:

first annular shroud means surrounding said plug and extending past said plug toward said socket;

second annular shroud means surrounding said socket and extending past said socket toward said plug, one of said first annular shroud means and said second annular shroud means being telescopically receivable in the other of said first annular shroud means and said second annular shroud means to permit said plug to be inserted into said socket, said one of said first annular shroud means and said second annular shroud means being partly telescoped into the other of said first annular shroud means and said second annular shroud means to a partly telescoped position before said plug is inserted into said socket;

aperture means in said first annular shroud means and extending across said first annular means between said plug and said socket;

aperture means in said second annular shroud means and extending across said second annular shroud means between said plug and said socket, said aperture means in said second annular shroud means being in alignment with said aperture means in said first annular shroud means when said first annular shroud means and said second annular shroud means are in said partly telescoped position; and locking bar means, said locking bar means being insertable between said socket and said plug when said first annular shroud means and said second annular shroud means are in said partly telescoped position to prevent said plug from making electrical contact with said socket, said locking bar means being selectively withdrawable from between said plug and said socket to permit said plug to make contact with said socket.

13. The combination according to claim 12 wherein one of said first annular shroud means and said second annular shroud means is a generally cup-shaped member, said generally cup-shaped member being formed of a non-conducting material to help to prevent electrical shock to a person grasping said one of said first annular shroud means and said second annular shroud means.

14. The combination according to claim 12 wherein said second annular shroud means defines an annulus surrounding said socket and wherein said first annular shroud means is telescopically receivable in said second annular shroud means at least partly in said annulus surrounding said socket.

15. The combination according to claim 12 wherein said locking bar means comprises a generally T-shaped bar having a head portion and a shank portion, said shank portion being insertable through said aperture means in said first annular shroud means and said aperture means in said second annular shroud means, said head portion not being insertable through said aperture means in said first annular shroud means and said aperture means in said second annular shroud means.

16. The combination according to claim 12 and further comprising:

flexible cable means, said flexible cable means securing said locking bar means to one of said plug and said socket to safeguard against the loss of said locking bar means.

17. The combination according to claim 12 wherein said one of said first annular shroud means and said second annular shroud means is generally circular in cross-section and comprises a flexible finger having a free end that is resiliently deflectable radially inwardly of said one of said first annular shroud means, said flexible finger having a tab projecting radially outwardly from said free end thereof, and wherein said other of said first annular shroud means and said second annular shroud means is generally circular in cross-section and comprises a generally L-shaped slot having a longitudinally extending portion and a laterally extending portion, said tab being receivable in said generally L-shaped slot to form a bayonet fit between said one of said first annular shroud means and said second annular shroud means by twisting said one of said first annular shroud means and said other of said first annular shroud means relative to one another to position said tab in said laterally extending portion of said generally L-shaped slot, said plug being in electrical contact with said socket when said tab is positioned in said laterally extending portion of said generally L-shaped slot.

* * * * *

UNITED STATES PATENT AND TRADEMARK OFFICE

CERTIFICATE OF CORRECTION

PATENT NO. : 4,721,475

DATED : January 26, 1988

INVENTOR(S) : Roland A. Burke, Jr.

It is certified that error appears in the above-identified patent and that said Letters Patent is hereby corrected as shown below:

In the Claims

Column 6, line 8, delete "content" and insert ---- contact ----.

Column 6, line 35, delete "said locking bar means,".

Column 6, line 61, delete "fonmed" and insert ---- formed ----.

Signed and Sealed this

Eighteenth Day of October, 1988

*Attest:*

DONALD J. QUIGG

*Attesting Officer*

*Commissioner of Patents and Trademarks*